United States Patent [19]

Jackson

[11] 4,193,765

[45] * Mar. 18, 1980

[54] DRYCLEANING ASSEMBLY AND METHOD FOR REMOVING IMPURITIES AND RESIDUAL MOISTURE FROM AN ORGANIC DRYCLEANING SOLVENT

[76] Inventor: Herman R. Jackson, 1981 San Marco Blvd., Jacksonville, Fla. 32207

[ * ] Notice: The portion of the term of this patent subsequent to Mar. 7, 1995, has been disclaimed.

[21] Appl. No.: 862,882

[22] Filed: Dec. 21, 1977

[51] Int. Cl.[2] ..... D06L 1/10

[52] U.S. Cl. ..... 8/142; 210/60; 210/167; 210/203

[58] Field of Search ..... 210/59, 60, 16, 63 R, 210/50, 167, 200-203; 8/141, 142

[56] References Cited

U.S. PATENT DOCUMENTS

| | | | |
|---|---|---|---|
| 1,745,108 | 1/1930 | McBerty | 8/142 |
| 4,026,798 | 5/1977 | Castrantas et al. | 210/60 |
| 4,077,878 | 3/1978 | Jackson | 210/60 |

OTHER PUBLICATIONS

Gregory, T. C.; "Uses and Applications of Chemicals and Related Materials"; Reinhold Publishing Corp.; pp. 428, 429, (1966).

*Primary Examiner*—Benoit Castel

*Attorney, Agent, or Firm*—Sughrue, Rothwell, Mion, Zinn and Macpeak

[57] ABSTRACT

Residual moisture and sulfur and other residual reducing agent impurities contained in drycleaning solvents are removed by adding to the solvents an unsubstituted aromatic hydrocarbon or a halogen or alkyl substituted aromatic hydrocarbon and circulating the hydrocarbon-containing solvent through a filter system comprising two filters; one filter containing a solid acid and the other containing chromate compound.

13 Claims, 1 Drawing Figure

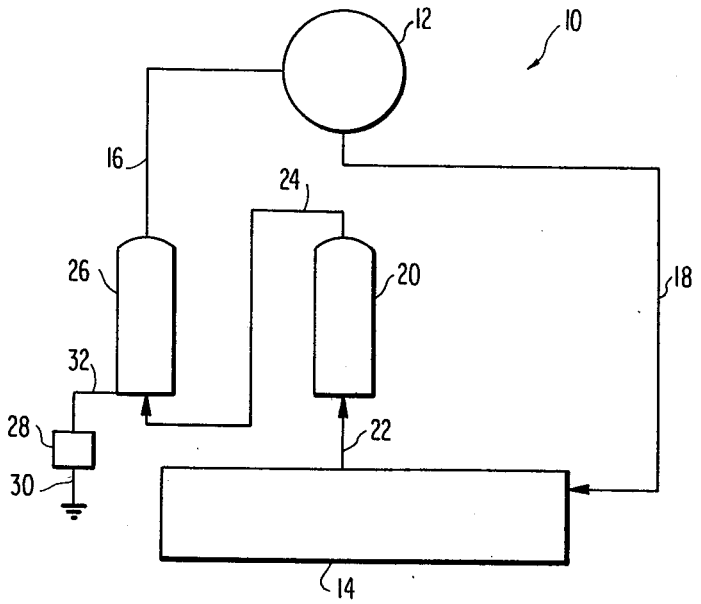
12
10
16
24
26
20
18
32
28
22
30
14

DRYCLEANING ASSEMBLY AND METHOD FOR REMOVING IMPURITIES AND RESIDUAL MOISTURE FROM AN ORGANIC DRYCLEANING SOLVENT

BACKGROUND OF THE INVENTION

1. Field of the Invention

The present invention concerns improving the cleaning properties of organic solvents used in drycleaning operations, and specifically, concerns improving the cleaning properties of such organic drycleaning solvents by removing residual moisture therefrom as well as sulfur and other residual reducing agents by the oxidation of the same.

2. Description of the Prior Art

In commercial drycleaning operations, various types of organic solvents have been employed in the past in the drycleaning process to remove soils from fabrics and clothing. For example, the prior art has employed solvents such as halogen-substituted aliphatic hydrocarbons such as perchloroethylene (tetrachloroethylene), mineral spirits, various types of petroleum solvents, mixtures of hydrocarbon and halogen-substituted hydrocarbon solvents with detergents, and the like. Typically, the petroleum solvents employed in drycleaning operations have a boiling point in the range of from about 200° F. to about 400° F. and a surface tension of from about 20 to about 30 dynes/cm at room temperature (i.e., 20° C.). A typical prior art formulation of a halogenated hydrocarbon solvent-detergent combination is manufactured by DuPont and sold under the trade name Valclene, which is a combination of a fluorocarbon solvent and a special high-performance detergent with a boiling point of about 118° F., a density of about 13.16 pounds per gallon at 68° F. and a surface tension at 68° F. of about 20 dynes/cm. A suitable fluorocarbon solvent is trichlorotrifluoroethane as the solvent constituent for Valclene.

Other solvents such as carbon tetrachloride and methylisobutylketone have also been employed in the past in commercial drycleaning operations. Due to the good stability and relatively high cost of these solvents, they are naturally reused and continuously recycled in the drycleaning process, and thus it becomes desirable to recondition the solvents by removing residual moisture, sulfur, and other residual reducing agents therefrom in order to provide reconditioned solvent for cleaning successive batches of soiled fabrics and clothing.

The prior art, in an effort to remove such impurities from drycleaning solvents, suggests that the formulations used as the solvents be distilled after the drycleaning operation; however, distillation is normally expensive and sometimes difficult to conduct without costly equipment, and problems arise in some instances because of the loose additives present in the drycleaning mixtures.

Another suggested solution for the removal of the impurities from the solvents is by a filtration and absorption technique wherein the impurities are selectively removed from the solvents after the same have been used to clean soiled fabrics. However, the use of such techniques is disadvantageous in that equipment cost becomes high, and other mechanical problems with respect to the apparatus prevent this method from being effectively conducted. In addition, the loose additives which may be present in the drycleaning formulation may tend to inhibit effective filtration and absorption.

The prior art also suggests the addition of water to common formulations of drycleaning mixtures in order to improve the drycleaning characteristics of the solvents employed for the cleaning operations. Normally, water would be added to drycleaning solvents to enable the solvents to dissolve water soluble components of stains on fabrics or clothing. However, most modern fabrics are non-wettable and the presence of water, even in small amounts, prevents the organic solvents, which are generally non-polar in nature, from dissolving slightly polar stains, such as fats, etc., in the solvents since the stains become hydrated through dipole-dipole bonding with the water molecules.

During the drycleaning operation, the relative humidity of the solvent changes according to the humidity of the ambient air and that present in the fabric or clothing being cleaned. Normally, the relative humidity of the solvents is maintained at about 65–70% in order to dissolve, for example, salts and sugars from stains. However, the control of the amount of moisture which is present in organic drycleaning solvents is very important since serious problems are encountered if the amount of moisture in the solvents becomes either too high or too low.

Too much moisture in drycleaning solvents may result in fiber shrinkage or distortion, the dulling of colors of the fabrics or clothing being cleaned and possible fading of the fabrics. In addition, fabrics become harder to press following cleaning. Too low a moisture level in the solvent results in the redepositing of water-soluble substances on the fabrics or clothing being cleaned, with the result that stains cannot be effectively removed. Further, a low moisture content in the drycleaning solvent may result in carbon being redeposited on the fabric, thereby adversely affecting the color of the fabric and leaving the fabric with static electricity charges which make it uncomfortable for a person to subsequently wear the clothing; in addition, the presence of static electricity charges present a danger of explosion with certain types of solvents.

In addition to the problems inherent in the use of drycleaning solvents containing too much or too little moisture, other problems are apparent due to the presence of impurities, such as sulfur and other reducing agents in drycleaning solvents. Such impurities may deposit on the fibers of the clothing being cleaned, resulting in discoloration and spotting thereof, or their presence in the solvents may result in fading of the colors of the fabrics being cleaned, may cause odors to remain on the cleaned products, and in addition, especially with respect to sulfur impurities, may cause corrosion of the equipment being used to clean the material.

Accordingly, it would be desirable to very strictly control the moisture content of drycleaning solvents in order to prevent, primarily, shrinkage of clothing being cleaned, and also to prevent adverse static electricity effects. Further, it would be desirable to remove impurities such as sulfur from drycleaning solvents in order to make the drycleaning process more effective and to prevent adverse effects such as color fading and corrosion of the equipment employed in the drycleaning operation.

In the inventor's U.S. Pat. No. 3,766,075, an invention is disclosed whereby residual moisture and impurities contained in typical formulations of drycleaning solvents are removed, without the adverse effects known to the prior art, and adding an unsubstituted aromatic hydrocarbon or a halogen- or alkyl-substituted aromatic hydrocarbon together with a dried cellulosic material onto which has been precipitated a fine deposit of an oxidizing agent such as lead dichromate to an organic drycleaning solvent. The treated cellulosic material is disclosed in that patent as absorbing excess moisture present in the solvent mixture as well as removing impurities therefrom through oxidation by means of the employed dichromate. In the inventor's copending U.S. application Ser. No. 657,332, filed Feb. 11, 1976, now issued as U.S. Pat. No. 4,077,878, an improvement in the aforesaid process is disclosed wherein the dichromate compound is precipitated onto a dried cellulosic material which is contained in a permeable cellulosic bag. The bag is electrically grounded by attaching a wire thereto or the bag is attached to a ground via a DC power supply.

The present invention is an improvement on the preceding drycleaning method.

According, it is the principal object of the present invention to provide a means for removing residual moisture from typical formulations of drycleaning solvents.

It is a further object of the present invention to provide improved drycleaning compositions free of residual moisture and impurities, without the adverse effects known in the prior art.

The present invention provides an improved drycleaning system and method which comprises adding an unsubstituted or halogen- or alkyl-substituted aromatic hydrocarbon to an organic drycleaning solvent and circulating the mixture to a filter arrangement comprising a first filter wherein the mixture is contacted with a solid acid, and a second filter wherein the mixture is contacted with chromate compound. The chromate compound or, in the case where the filter containing the chromate compound is metallic, the filter itself is grounded or attached to a ground via a DC power supply.

DESCRIPTION OF THE DRAWING

FIG. 1 is a schematic diagram which illustrates a drycleaning system based on the present invention.

DESCRIPTION OF THE PREFERRED EMBODIMENT

Referring to the drawing, FIG. 1 shows a cleaning assembly 10 including a cleaning drum 12 which receives articles to be cleaned and a base tank 14 for the drycleaning solvent. Generally, the present invention is applicable to any type of organic drycleaning solvent normally employed in drycleaning operations. Many types of solvents are well-known in the art, as indicated by the above discussion; and those of ordinary skill in the art will realize that the efficacy of the present invention is not limited to a certain class of organic drycleaning solvents. Preferably, the solvents which are employed in the present invention are aliphatic halogen-substituted hydrocarbons, or more preferably, petroleum solvents having a boiling point in the range of from about 100°–400° F. and a surface tension of from about 20 to about 30 dynes/cm at 20° C. Typical examples of such halogen-substituted aliphatic hydrocarbons are trichlorotrifluoroethane, carbon tetrachloride, perchloroethylene, and the like. Typical suitable petroleum solvents are mineral spirits, petroleum ethers, methylisobutylketone, and the like. It is to be specifically understood, that the present invention is especially applicable to any petroleum solvent having the above properties.

The drycleaning drum 12 is provided with an inlet conduit 16 and an outlet conduit 18 which form means for circulating the drycleaning solvent into the drum 12 and back to the storage tank 14. The unit also includes a pump, not shown, for urging the drycleaning solvent into the drum, and a motor for rotating the drum. A gear assembly of a conventional type may be utilized for varying the speed of the drum as controlled by the timer. Such assemblies are individually well-known and of conventional type.

A first filter assembly 20 is incorporated in the drycleaning system 10 for contacting the drycleaning solvent with the solid acid. The construction of the filter assembly is not critical, it being necessary only to provide an arrangement whereby the solvent may pass through the filter assembly and contact the solid acid without substantially removing the acid from the assembly. Generally, the filter may be cylindrical in form and constructed of an imperforate casing having a filter container inlet and a filter container outlet.

Filter 20 containing the solid acid is interconnected to the base tank via inlet conduit 22 and to filter 26 containing the chromate compound via outlet conduit 24. After contacting the solid acid in the solid acid filter 20, the solvent circulates out of filter 20 to conduit 24 where it is carried to filter 26 for contact with the chromate compound.

Again, the construction of filter 26 is not critical, it only being necessary that the arrangement permit the solvent to contact the chromate compound without carrying substantial portions of the compound into the drycleaning drum.

In accordance with the present invention, the chromate compound must be grounded. When the filter container 26 is formed of a metallic material, the ground can be accomplished by grounding the filter assembly itself. Of course, if the filter container is plastic or constructed of some non-conductive material, the chromate compound can be grounded by having the wire lead into inside the filter container. FIG. 1 shows that embodiment of the present invention wherein filter 26 is metallic and the filter assembly itself is grounded via a DC power supply 28. The positive terminal of the DC power supply is connected to wire 30 leading to the ground and the negative terminal is connected to the filter by wire 32.

The chromate compound may be added directly into filter 26 or placed inside the container in a bag made of a permeable cellulosic material such as cotton cloth. The cellulosic container device described in the inventor's copending application Ser. No. 657,332, now issued as U.S. Pat. No. 4,077,878, filed Feb. 11, 1976, may also be used in the filter. In the alternative, the filter itself may be constructed of cellulosic board.

The present invention contemplates adding to such organic drycleaning solvents an unsubstituted aromatic hydrocarbon or a halogen- or alkyl-substituted aromatic hydrocarbon having a boiling point between about 78° and about 250° C. Typical examples of suitable unsubstituted aromatic hydrocarbons are benzene and naphthalene. Suitable alkyl-substituted aromatic hydrocarbons are lower alkyl, perferably methyl- or ethyl-substituted aromatic hydrocarbons, such as xylene, toluene, and the like. Further, suitable halogen-substituted aromatic hydrocarbons are chlorobenzene and the like. However, the present invention is expressly applicable to those compounds satisfying the above property, although not specifically enumerated in the present specification. Those of ordinary skill in the art, with a minimum degree of experimentation, are certainly able to practice the present invention using aromatic compounds having the necessary boiling point but not specifically identified herein, according to the end use desired.

Generally, the amount of the above-identified aromatic compound which is incorporated into the organic drycleaning solvent composition varies from 3 liquid ounces to 1 gallon of aromatic compound per 100 gallons of organic solvent. The particular amount of a specific aromatic hydrocarbon may vary within this range, depending upon the aromatic hydrocarbon selected; however, an amount of aromatic hydrocarbon within this range is generally suitable for the purposes of the present invention.

The chromate compound used in the present invention is preferably barium chromate; however, the chromates and dichromates of sodium, potassium, barium and lead are representative. The amount of chromate compound contained in the second filter is not critical. One of the advantages of the present invention is that practically any amount of chromate compound will remain active for the life of the drycleaning solvent. This is because the amount of residual moisture and impurity in the drycleaning solvent is small in comparison to the amount of chromate compound which can be held in the filter arrangement and only the residual moisture in the solvent dissolves the chromate compound.

The solid acid which is particularly preferred for use within the present invention is oxalic acid. Generally, however, any solid organic acid may be used within the present invention. Representatives of such solid organic acids are citric acid, oxalic acid, ascorbic acid, tartaric acid and azelaic acid. All of these acids are suitable for use within the described solid acid filter. Inorganic salts which are acidic in character may also be used as the solid acid in the present invention. Sodium bisulfite is exemplary. The amount of acid is not critical.

As indicated above, the present invention also contemplates the addition of a cellulosic bag device to the filter arrangement containing the chromate compound. The cellulosic bag device comprises a cellulose material which can be folded upon itself so as to be closed and thereby form a bag. Cotton cloth is a good example of one such cellulosic material. However, the skilled artisan could construct the cellulosic bag out of any available cellulosic fabric. The chromate compound may be contained within the bag directly or the chromate compound may be precipitated upon a second piece of cellulosic material which is placed in the cellulosic bag. Bags of this type are described in the inventor's copending application Ser. No. 657,332, now U.S. Pat. No. 4,077,878, which is incorporated herein by reference.

The chromate compound used in the present invention must be electrically grounded. As indicated above, this ground can be accomplished by one of several means. If the chromate compound is contained directly within a metallic filter arrangement, the filter itself may be grounded. If the filter apparatus is not metallic, however, the ground may be established by introducing a wire to the inside of the filter container. If the chromate compound is contained within the cellulosic bag, as described above, the ground can be enhanced by attaching a copper wire to the cellulosic bag within the filter apparatus. If the filter apparatus is metallic, the ground is established by merely allowing the copper wire attached to the cellulosic bag to contact the insides of the filter container. However, if the filter container is not metallic, the ground can be established by connecting the wire attached to the cellulosic bag directly to a ground.

The present invention can also be practiced using a DC power supply. When the aromatic hydrocarbon added to the drycleaning solvent is naphthalene, the DC power supply is not necessary. However, even when naphthalene is used, the DC power supply will not detract from the advantages obtained in accordance with the present invention. When a DC power supply is used, the negative terminal of the power supply is connected to the filter containing the chromate compound and the positive terminal of the power supply is connected to a ground.

It has been determined that by adding the aromatic hydrocarbon to the drycleaning solvent and contacting the solvent with a solid acid and a chromate compound as in the present invention, residual moisture in the drycleaning solvent is effectively removed. The prior art indicates that at extremely low humidities, carbon becomes redeposited on the clothes being cleaned, resulting in adverse static electricity effects. However, the drycleaning system of the present invention removes large amounts of soil without redeposition on the clothing being observed. Further, the adverse static electricity effects noticed when prior art compositions are employed at low humidities are substantially eliminated by the present invention, and therefore, the wearer of the clothing, after cleaning, does not experience uncomfortable effects therefrom; and, in addition, the reduction of static electricity charges in the clothing reduces any explosion hazard which may exist, depending upon the particular solvent employed.

The use of the instant drycleaning system results in extremely uniform cleaning, without the adverse effects of shrinkage, color fading, dullness of colors, etc. In addition, stains comprised of carbon, salt, sugar, fats, etc. in the clothes being cleaned are substantially completely removed from the clothes without any adverse effects. Thus, the present invention provides an improved drycleaning composition which enables those skilled in the art to achieve extremely uniform drycleaning operations without the adverse effects of the prior art.

It is believed that the chromates used in the present invention adsorb the residual water in the drycleaning solvent and remove the impurities, such as sulfur compounds, from the drycleaning solvent by oxidizing the same to sulfite or sulfate, which then are removed by dissolving the same in the water adsorbed on the chromate compound.

It has further been found that the addition of from about 0.5–5%, by weight, based on the weight of the organic drycleaning solvent, of a hydrocarbon of a high boiling point, such as white oil, increases the ease of removal of carbon, salt and sugar deposits from the clothes in the drycleaning process. One type of useful white oil is Chevron No. 72, which is a well-known technical oil.

The above description should not be taken as limiting the present invention to the actual embodiments specifically disclosed, but should be deemed to described the equivalence thereof which may be employed in the practice of the present invention. Those of ordinary skill in the art may make suitable modifications of the present invention, according to the above description, without departing from the scope thereof.

I claim;

1. A method for removing impurities and residual moisture from an organic drycleaning solvent comprising in sequence:

(a) adding to said solvent an unsubstituted or halogen- or alkyl-substituted aromatic hydrocarbon;

(b) circulating said aromatic hydrocarbon-containing solvent through a filter containing a solid acid, such that said solvent contacts said acid; and (c) circulating said aromatic hydrocarbon-containing solvent through a second filter apparatus containing a chromate compound, said second filter apparatus being electrically grounded or attached to an electric ground via a DC power supply.

2. The method of claim 1 wherein said aromatic hydrocarbon is naphthalene.

3. The method of claim 2 wherein said solid acid is oxalic acid.

4. The method of claim 3 wherein said chromate compound is barium chromate.

5. The method of claim 2 wherein said acid is selected from the group consisting of citric acid, oxalic acid, ascorbic acid, tartaric acid, and azelaic acid, and other organic acids in a powder form.

6. The method of claim 1 wherein said acid is sodium bisulfite.

7. The method of claim 1 wherein said chromate compound is contained in a permeable cotton bag having one end of a wire connected thereto, the other end of said wire being directly or indirectly in contact with an electrical ground.

8. In a drycleaning system comprising a cleaning drum and a base tank wherein the drycleaning solvent circulates between the cleaning drum and the base tank, the improvement which comprises interconnecting in series between said cleaning drum and said base tank two filters; a first filter containing a solid acid and a second filter containing chromate compound, such that solvent passes from the base tank through the first filter and then the second filter en route to the drum, said chromate compound being connected to an electrical ground or to an electrical ground via a DC power supply.

9. The apparatus of claim 8 wherein said solid acid is oxalic acid.

10. The apparatus of claim 8 wherein said acid is selected from the group consisting of citric acid, oxalic acid, ascorbic acid, tartaric acid, and azelic acid.

11. The apparatus of claim 8 wherein said acid is sodium bisulfite.

12. The apparatus of claim 8 wherein said chromate compound is barium chromate.

13. The apparatus of claim 8 wherein said chromate compound is disposed within said second filter in a permeable cellulosic bag having a wire connected thereto which directly contacts an electrical ground or contacts an electrical ground via a D.C. power supply.

* * * * *